US006698221B1

(12) United States Patent
You

(10) Patent No.: US 6,698,221 B1
(45) Date of Patent: Mar. 2, 2004

(54) REFRIGERATING SYSTEM

(76) Inventor: Kyung Kon You, 472-1 Bangchori, 11 Jukmyeon, Anseorjshi, Konggydo (KR)

( * ) Notice: Subject to any disclaimer, the term of this patent is extended or adjusted under 35 U.S.C. 154(b) by 0 days.

(21) Appl. No.: 10/335,937

(22) Filed: Jan. 3, 2003

(51) Int. Cl.[7] ..... F25B 41/00

(52) U.S. Cl. ..... 62/196.4; 62/500

(58) Field of Search ..... 62/196.4, 500, 62/524, 525, 526

(56) References Cited

U.S. PATENT DOCUMENTS 4,194,367 A * 3/1980 Lavik ..... 62/138
4,719,763 A * 1/1988 Tietze ..... 62/186
5,127,471 A * 7/1992 Weislogel ..... 165/104.22
5,722,257 A * 3/1998 Ishii et al. ..... 62/505
6,266,989 B1 * 7/2001 Pohl et al. ..... 72/245

FOREIGN PATENT DOCUMENTS

JP 354104140 A * 8/1979 ..... 62/440

* cited by examiner

*Primary Examiner*—Melvin Jones
(74) *Attorney, Agent, or Firm*—Larry J. Moskowitz; Dickinson Wright PLLC

(57) ABSTRACT

Disclosed is a refrigerating system which retrieves energy lost when the pressure necessary to make refrigerant flowing is changed from high pressure to low pressure and reuses the energy as a power source for increasing the pressure again, thereby reducing the amount of energy used in the refrigerating system and improving the performance of the system. The refrigerating system including a condenser, an expansion valve, an evaporator and a compressor is provided with a plurality of magnet valves connected to the output part of the compressor and the output part of the condenser for measuring the temperature and pressure of a part of the refrigerant discharged from the compressor and condenser; a plurality of by-pass pipes for by-passing the part of the refrigerant to the compressor; and an ejector connected to the by-pass pipes for ejecting the part of the refrigerant fed from evaporator back to the compressor based on the venturi principle.

11 Claims, 15 Drawing Sheets

REFRIGERATING SYSTEM

BACKGROUND OF THE INVENTION

1. Field of the Invention

The present invention relates to a refrigerating system, and more particularly, to a refrigerating system for retrieving energy lost when pressure necessary to make refrigerant flowing is changed from high pressure to low pressure to enhance energy efficiency, and reusing the energy as a power source for increasing the pressure again.

2. Background of the Related Art

In general, a compressor in a refrigerating system compresses and pumps refrigerant. The refrigerant compressed by the compressor becomes gaseous refrigerant while passing through a capillary tube or an expansion valve, for example. The conventional refrigerating system employing such a refrigeration cycle causes many problems in circulating the refrigerant. That is to say, whereas external power is required when the pressure necessary to make the refrigerant of the refrigerating system flowing is changed from low pressure to high pressure, the pressure is naturally decreased when the pressure necessary to make the refrigerant flowing is changed from high pressure to low pressure such that power loss occurs unnecessarily. In further detail, the power used in the conventional refrigerating system serves to only increase the pressure of the refrigerant. However, since the pressure necessary to make the refrigerant flowing is hydro-dynamically changed from high pressure to low pressure through the capillary tube or the expansion valve as a natural result, the power used to increase the pressure of the refrigerant is lost as a whole.

In other words, energy necessary when the pressure of the refrigerant is changed from high pressure to low pressure is the same as that necessary when the pressure of the refrigerant is changed from low pressure to high pressure. Thus, if the energy lost when the pressure of the refrigerant is changed from high pressure to low pressure is retrieved and reused, the energy efficiency of the refrigerating system will be accordingly enhanced. Also, if the retrieved energy is used for the compressor, energy to be used for the compressor is proportionally saved, thereby improving the energy efficiency of the system.

However, the refrigerating system is not actuated based on such a simple principle or devices as we can imagine, and not be actuated by using simple pressure, such as high pressure and low pressure. The refrigerating system is called a heat pump for transferring heat by circulating refrigerant inside the refrigerating system to change the pressure and state of the refrigerant.

When the refrigerant circulates through long coils and various types of devices in the system, there is generated resistance against passage of fluid, i.e., pipe resistance. In an energy-exchanging device for changing between low pressure and high pressure, there are generated friction loss in a rotation unit, heat loss and a decrease in capacity efficiency. When the refrigerating system is provided with an auxiliary compressor for compensating for the loss and an auxiliary motor mounted on a rotary shaft of the energy-exchanging device when pressure is changed from low pressure to high pressure for compensating for the loss, the necessity of a motor having high power is eliminated.

If such a refrigerating system is realized based on the above theory, a conventional absorption cooling system or a chiller-heater of an absorption refrigerating system using water, ammonia or lithium bromide will not be required any more. The problem of a decrease in engine load and speed of a car and a continued ratio caused when an air conditioner is used in the car in summer will be solved as well. The shortage of power supplied and demanded in summer due to an increase in the use of refrigerating systems will be also solved.

A conventional refrigerating system will be described as follows with reference to FIG. 14.

Referring to FIG. 14, the conventional refrigerating system includes a compressor 10 for compressing gaseous refrigerant under high temperature and high pressure up to condensing pressure, a condenser 12 for condensing the gaseous refrigerant compressed by the compressor 10 into a liquid state through an air blast of a cooling fan 12*a* to release heat (if the condenser is a water-cooled type, it uses water instead of air to condense the refrigerant. Even though other cooling agents or devices can be used, the present embodiment uses air for explanation.), an expansion valve 24 for expanding the liquid refrigerant condensed by the condenser 12 under high temperature and high pressure into gaseous refrigerant under low pressure by throttling action, and an evaporator 26 for evaporating the gaseous refrigerant expanded by the expansion valve 24 while cooling air which is blasted by a blast fan 26*a* using evaporating heat of the refrigerant by heat exchange, and returning the gaseous refrigerant to the compressor 10.

In the meantime, the refrigerant should be continuously changed between a gaseous state and a liquid state during the refrigeration cycle. When the refrigerant contains water, the water is frozen in the expansion valve or the capillary tube while circulating through the refrigerating system during the refrigeration process, thereby causing a shut-off of the refrigeration cycle and stopping the refrigerating system. Since the state of the refrigerant cannot be changed smoothly, the refrigerating system cannot be operated well and may be rusted. In case of the refrigerating system employing ammonia, if water is permeated thereinto, dilution occurs due to ammonia water. Therefore, if the amount frozen is small, it will not stop the refrigerating system. However, since evaporating pressure is increased during the dilution, water separation needs to be done.

To solve the problem due to the water, the conventional refrigerating system is provided with a drier (for adsorbing porous material, such as silica gel) interposed between the condenser 12 and the expansion valve 24 in order to adsorb the water contained in the refrigerant, and a fluid receiving tank 15 interposed between the condenser 12 and the drier 18 for supplying only the liquid refrigerant to the expansion valve 24.

The drier 18 has a desiccant and a filter embedded therein, and the desiccant absorbs the water from the refrigerant introduced from the condenser 12 toward the expansion valve 24 and the filter filters impurities, except water, contained in the refrigerant.

The fluid receiving tank 15 temporarily stores the liquid refrigerant dealing with a load variation of the refrigeration cycle, separates pre-condensed refrigerant or non-condensable gas contained in the liquid refrigerant, and protects the system by forcibly discharging the refrigerant by means of a fusible plug, if any, when the refrigerant is overheated due to failure of the system.

Meantime, when the gaseous refrigerant discharged from the evaporator 26 is not completely evaporated, water is contained in the discharged gaseous refrigerant. Therefore, since the gaseous refrigerant existing in a pipe line between the evaporator 26 and the condenser 10 is changed into a liquid state when the refrigerating system is stopped, the water may be introduced into the compressor 10.

However, since the water is incompressible fluid, when the water is introduced into the compressor 10, there is generated a liquid compression phenomenon in which a so-called hammering noise is made, and there is caused the burning in the compressor 10 because the water is not compressed.

Accordingly, it is necessary to fundamentally prevent the liquid refrigerant from being introduced into the compressor 10. To do that, a gas and liquid phase separator 29 is interposed between the evaporator 26 and the compressor 10 for separating the liquid refrigerant and supplying only the gaseous refrigerant to the compressor 10.

To protect the compressor 10 from being damaged when impurities are introduced into the compressor 10, a filter 32 is interposed between the gas and liquid phase separator 26 and the compressor 10 for filtering the impurities.

Reference numeral 16 designates a solenoid valve for preventing the refrigerant from being discharged through the fluid receiving tank 15, and reference numeral 22 designates a sight glass.

In the conventional refrigerating system, there is caused huge resistance when the refrigerant passes through the fluid receiving tank 15, the drier 18 and the solenoid valve 16. And, there is caused a severe change in pressure due to the alternating flow of filled state and semi-filled state when the refrigerant arrives at the right front of the expansion valve 24 due to its control of the amount of refrigerant even though the refrigerant is filled with only water when passing through the fluid receiving tank 15.

To ensure prevention of the resistance and pressure change, the fluid receiving tank 15 is excessively filled with the water. In this case, disadvantageously, the volume of the fluid receiving tank 15 is increased and the amount of refrigerant charged is also increased. Since the amount of Freon used is restricted since Montreal Protocol (which limits the use of Freon refrigerant which depletes the ozone layer), it is necessary to develop a refrigerating system using a small amount of Freon charged.

Further, in the conventional refrigerating system, the gas and liquid phase separator 29 interposed between the evaporator 26 and the compressor 10 is structured in such a manner that a gas and liquid phase separating pipe installed therein is bent in the shape of U so as to prevent the liquid refrigerant from being introduced thereinto.

SUMMARY OF THE INVENTION

Accordingly, the present invention is directed to a refrigerating system that substantially obviates one or more problems due to limitations and disadvantages of the related art.

An object of the present invention is to provide a refrigerating system for retrieving energy lost when pressure necessary to make refrigerant flowing is changed from high pressure to low pressure in order to enhance energy efficiency and reusing the energy as a power source for increasing the pressure again.

To achieve these objects and other advantages and in accordance with the purpose of the invention, as embodied and broadly described herein, there is provided a refrigerating system comprising: a refrigerant circulating part having a compressor for compressing refrigerant, a condenser for condensing the refrigerant and an evaporator for evaporating the refrigerant; a plurality of magnet valves connected to the output part of the compressor and the output part of the condenser for measuring the temperature and pressure of a part of the refrigerant discharged from the compressor and condenser; a plurality of by-pass pipes communicating with the magnet valves and operated under the control of the magnet valves for by-passing the part of the refrigerant to the compressor in order to recompress it; and an ejector connected to the by-pass pipes and the evaporator for ejecting the part of the refrigerant fed from the by-pass pipes and the refrigerant fed from the evaporator back to the compressor based on the venturi principle to compensate for reduced energy of the compressor.

It is desirable that the refrigerating system further includes a controller for controlling the overall operation of the refrigerating system.

It is desirable that the refrigerating system further includes a housing interposed between the ejector and the compressor and connected to the output part of the condenser and the input part of the evaporator for completely evaporating the refrigerant flowing from the evaporator and passing therethrough.

It is desirable that the refrigerating system further includes a first pump interposed between the ejector and the compressor for increasing the pressure of the refrigerant flowing from the ejector and a second pump interposed between the condenser and the evaporator and coaxially disposed with the first pump for expanding the refrigerant flowing from the condenser.

It is desirable that the refrigerating system further includes a motor interposed between the first pump and the second pump.

It is desirable that the refrigerating system further includes a third pump interposed between the ejector and the condenser for increasing the pressure of the refrigerant flowing from the ejector.

It is desirable that the refrigerating system further includes a cooler interposed between the first pump and the third pump for decreasing the temperature of the refrigerant flowing from the first pump.

In another aspect of the present invention, there is also provided a refrigerating system including: a compressor for compressing and pumping refrigerant; a condenser connected to the compressor for condensing the refrigerant pumped by the compressor by means of cooling water; and an evaporator having two closed chambers and connected to the condenser for evaporating the refrigerant flowing from the condenser while making the refrigerant flowing through the chambers thereof vertically or horizontally.

It is desirable that the refrigerating system further includes a controller for controlling the overall operation of the refrigerating system.

It is desirable that the refrigerating system further includes a cooling water container for circulating the cooling water therethrough, the condenser being installed inside the cooling water container.

It is desirable that the cooling water container is a split-type, and a part of the refrigerant flowing from a first cooling water container is introduced to a second cooling water container.

The above objects, advantages and other features of the present invention will be apparent upon a reading of the following description with reference to the appended drawings.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

First Embodiment

Figure 14:
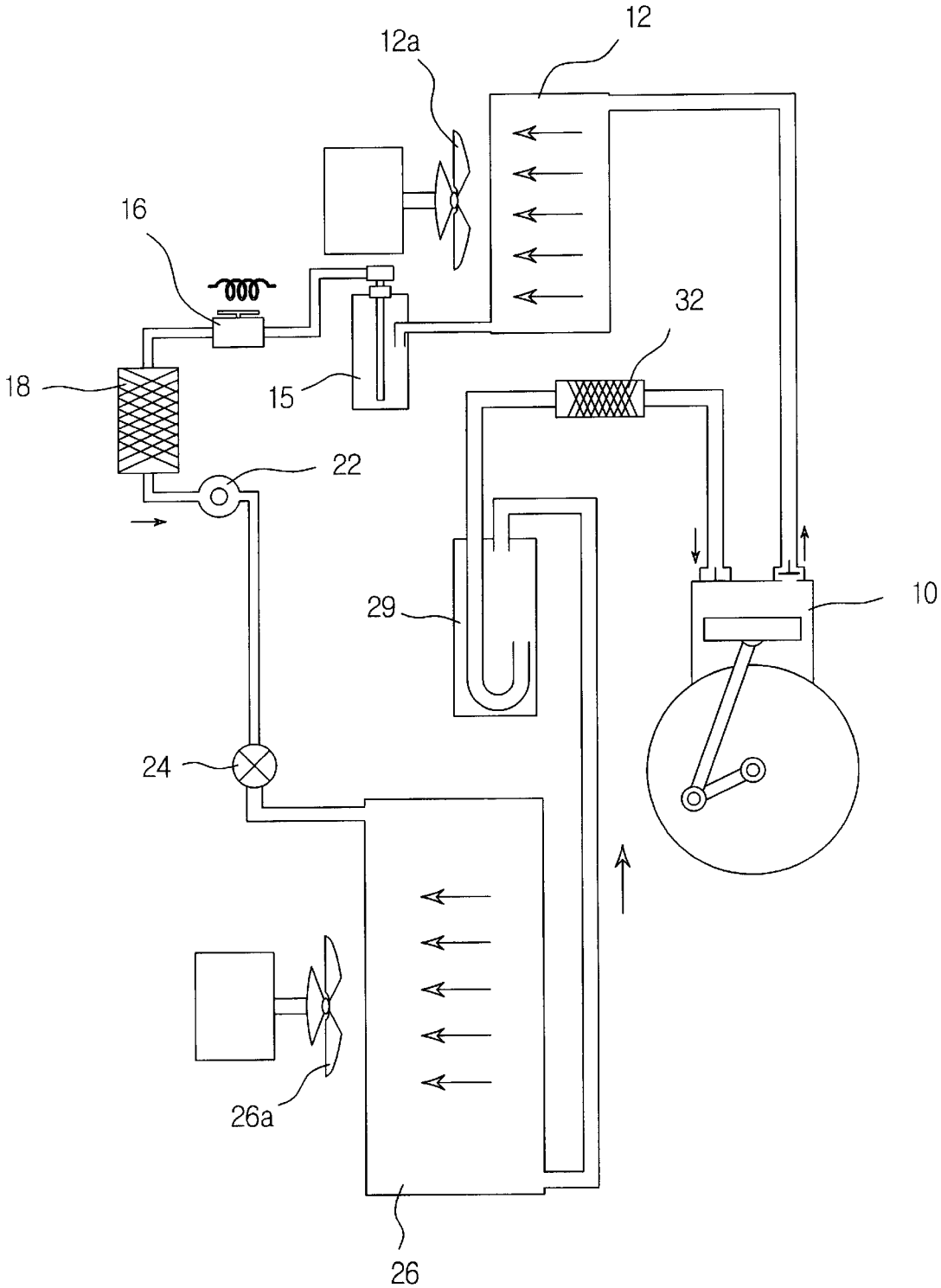
FIG. 14 is a schematic diagram of a conventional refrigerating system.

Reference will now be made in detail to the preferred embodiments of the present invention, examples of which are illustrated in the accompanying drawings. Like reference numerals designate identical or corresponding parts throughout the conventional art in FIG. 14 and a first preferred embodiment of the present invention, and the same parts will not be explained to avoid repetition.

Figure 1:
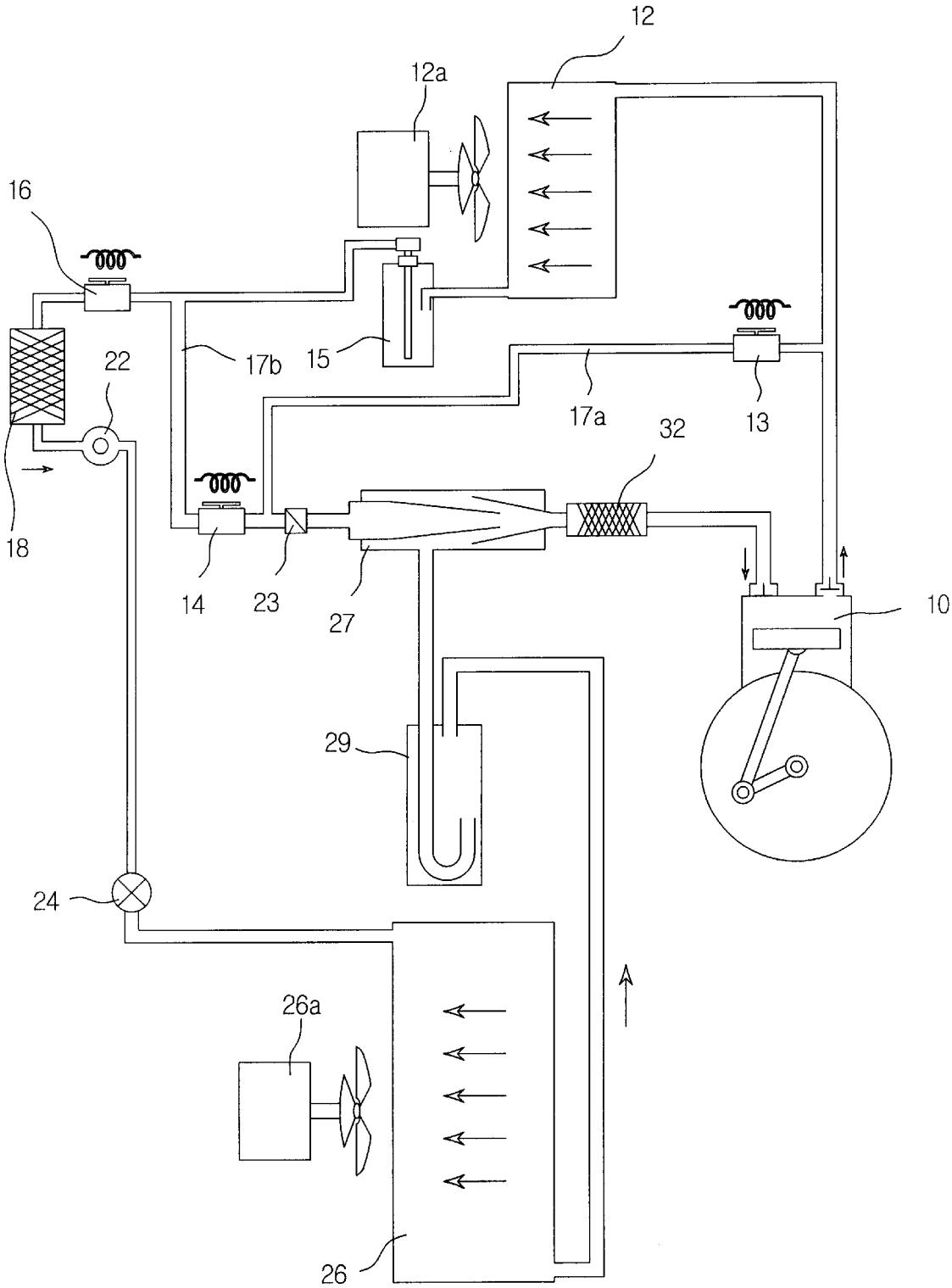
FIG. 1 is a schematic diagram of a refrigerating system according to a first preferred embodiment of the present invention.

FIG. 1 is a schematic diagram of a refrigerating system according to a first preferred embodiment of the present invention.

Referring to FIG. 1, reference numeral 10 designates a compressor. The compressor 10 acts to compress refrigerant and pumps the compressed refrigerant to circulate it through the system. The compressor 10 compresses the refrigerant by using one method selected from the group consisting of a reciprocating method, a crank method, a wobble plate method, a rotary method and a scroll method. The refrigerant compressed by the compressor is in a gaseous state under high temperature and high pressure.

A condenser 12 is connected to the compressor 10. The condenser 12 is connected to the output part of the compressor 10. The condenser 12 changes the refrigerant, namely, the gaseous refrigerant under temperature and high pressure, into liquid refrigerant under high temperature and high pressure. This process is called condensation. The condensation can be done because the condenser 12 gets rid of the heat of the refrigerant. Specifically, the upper header and the lower header are arranged in parallel with each other in the condenser 12. A plurality of tubes are connected to the upper and lower headers at opposite ends thereof. A plurality of corrugate-type heating fins are stacked alternately between adjacent tubes. Thus, cool air supplied from a cooling fan 12*a* adjacent to the condenser 12 passes between the plurality of tubes, and the heating fins allow the heat of the refrigerant that passes through the plurality of tubes to be radiated. Therefore, the refrigerant passing through the plurality of tubes can be changed into a liquid state. In this manner, the condenser 12 changes the gaseous state of the refrigerant into the liquid state. Herein, the refrigerant is under high temperature and high pressure.

A fluid receiving tank 15 is connected to the condenser 12. A solenoid valve 16 is connected to the fluid receiving tank 15. The solenoid valve 16 prevents the refrigerant exiting the condenser 12 from being discharged through the fluid receiving tank 15. Further, a drier 18 is connected to the solenoid valve 16. The drier 18 removes water from the refrigerant and filters the refrigerant. To do that, the drier 18 is provided with a desiccant and a filter. Accordingly, the desiccant absorbs the water and the filter filters off impurities.

Meanwhile, an evaporator 26 is connected to the input part of the compressor 10. The evaporator 26 evaporates the refrigerant so as to exchange heat with external material, for example, external air. The material subjected to the heat exchange by the evaporator 26 is deprived of heat by the refrigerant and accordingly gets cold whereas the refrigerant absorbs the heat and accordingly gets hot. Through the process, the function of refrigeration and cold storage can be performed.

A gas and liquid phase separator 29 is interposed between the evaporator 26 and the compressor 10 for separating the liquid refrigerant from the gaseous refrigerant discharged from the evaporator 26 and feeding back only the gaseous refrigerant to the compressor. Moreover, a filter 32 is installed between the gas and liquid phase separator 29 and the compressor 10. The filter 32 filters off impurities contained in the refrigerant so as to protect the compressor 10 from being damaged.

An expansion valve is connected to the input part of the evaporator 26 for expanding and changing the liquid refrigerant under high pressure into one under low pressure. The refrigerant expanded by the expansion valve 24 can be easily evaporated in the evaporator 26 by taking away ambient heat. The heat is called evaporating heat. The expansion valve 24 can optionally employ an internal equalizing method in which the degree of opening of a path of the refrigerant under high pressure is controlled by means of a pressure transferring rod according to a variation in expansion of a diaphragm in connection with a change in temperature inside a thermal room, or an external equalizing method in which the degree of opening of the path of the refrigerant under high pressure is controlled by means of a capillary tube according to the variation in expansion of the diaphragm.

A fluid receiving tank 15 is interposed between the condenser 12 and the drier 18. The fluid receiving tank 15 stores the refrigerant under high pressure introduced from the compressor and discharges the refrigerant. In the first preferred embodiment, the fluid receiving tank 15 is smaller in size than a conventional one and may not be provided in the system if necessary. Reference numerals 12 and 26*a* designate the cooling fan and a blast fan.

According to the first preferred embodiment, two bypass pipes 17*a* and 17*b* are connected to the output parts of the compressor 10 and the condenser 12. The by-pass pipes 17*a* and 17*b* are also connected to the input part of the ejector 27. Further, the filter 32 is connected to the output part of the ejector 27. The ejector 27 acts to eject the refrigerant under high pressure by means of a nozzle and discharge or condense ambient vapor or heat. A magnet valve 13 is mounted on the by-pass pipe 17*a* for controlling the by-pass pipe 17*a* while a magnet valve 14 is mounted on the by-pass pipe 17*b* for controlling the by-pass pipe 17*b*.

Furthermore, the refrigerant exiting the evaporator 26 is supplied to the ejector 27, and the ejector 27 retrieves the refrigerant on the basis of the venturi principle. A check valve 23 is connected to the input part of the ejector 27 for preventing the refrigerant from flowing back to the evaporator. Reference numeral 22 designates a sight glass.

Accordingly, the refrigerant under low pressure passes through the evaporator 26, the gas and liquid phase separator 29 and the filter 32 and is delivered to the compressor 10 by virtue of the driving of the compressor 10. The refrigerant admitted to the compressor 10 is compressed by the compressor 10 to be changed into the gaseous refrigerant under high temperature and high pressure and then delivered to the condenser 12 again. The condenser 12 condenses the gaseous refrigerant under high pressure into the liquid refrigerant under high pressure. The liquid refrigerant under high pressure passes through the solenoid valve 16 and is delivered to the drier 18. The drier 18 filters water and impurities from the refrigerant.

During the procedure, the temperature and pressure of a part of the refrigerant fed from the compressor 10 and the condenser 12 are measured in the magnet valves 13 and 14. The operation of the magnet valves 13 and 14 is controlled based on the measured results. In addition, the part of the refrigerant passing through the magnet valves 13 and 14 passes through the by-pass pipes 17*a* and 17*b* and is supplied to the ejector 27. The ejector 27 ejects the part of the refrigerant by means of the nozzle and feeds it back to the compressor 10. In view of that, the ejector 27 compensates for the reduced capacity and pressure of the input part of the compressor 10. As a result, the performance of the compressor 10 is improved and the amount of power to be used is reduced. Additionally, the ejector 27 retrieves the refrigerant from the evaporator 26 based on the venturi principle.

According to the first preferred embodiment, the magnet valves 13 and 14 control the amount of refrigerant and the degree of hot temperature when the pressure of the evaporator is decreased and condensing pressure is increased. As a consequence, the first preferred embodiment can enhance the performance of the system and reduce the amount of power used for the compressor. When the first preferred embodiment is applied to a general refrigerator, an air conditioner, a heat pump, etc., it is highly expected that their performance will be improved and the amount of power required will be significantly reduced.

Second Embodiment

Figure 2:
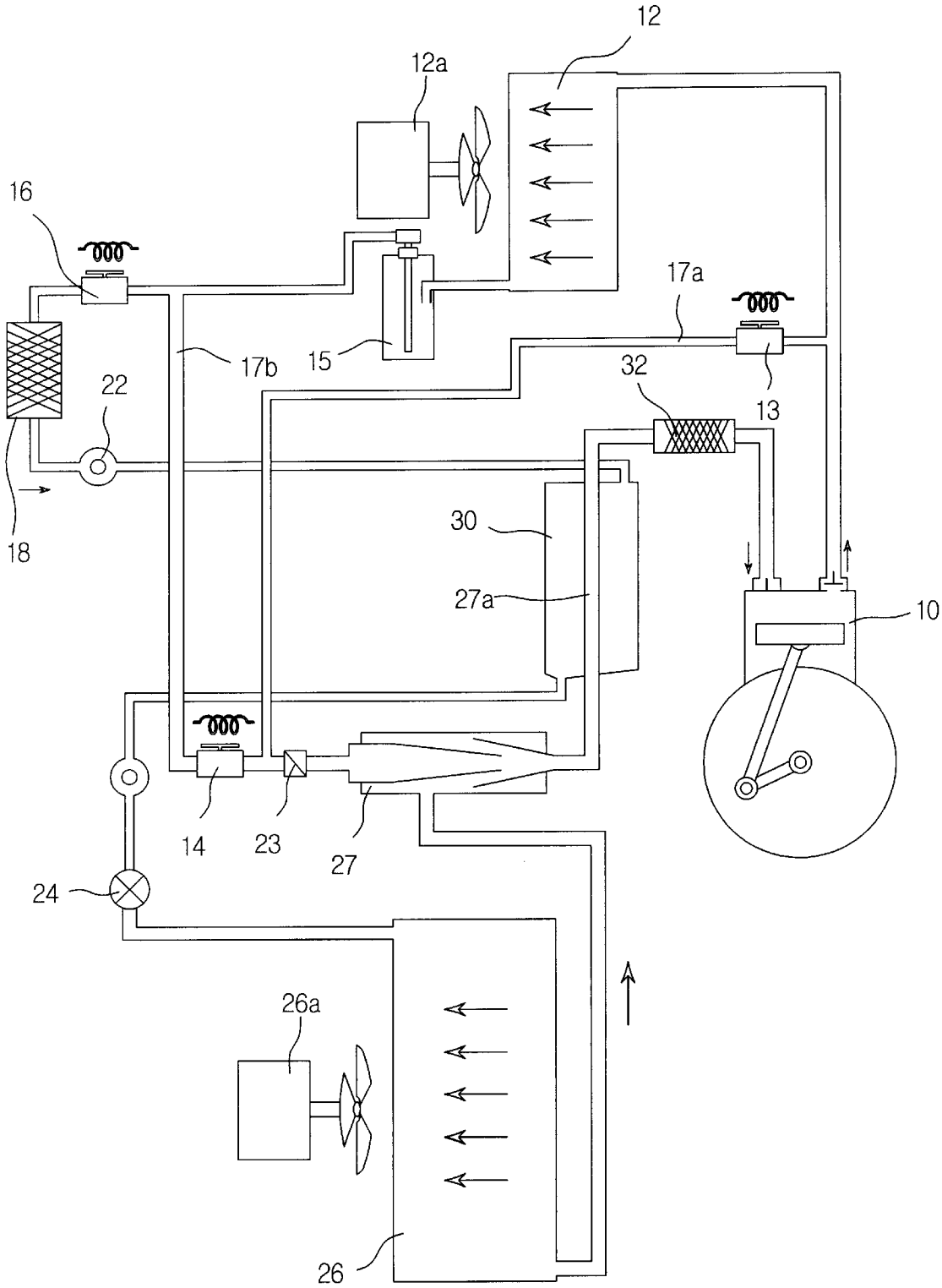
FIG. 2 is a schematic diagram of a refrigerating system according to a second preferred embodiment of the present invention.

FIG. 2 is a schematic diagram of a refrigerating system according to a second preferred embodiment of the present invention. Like reference numerals designate identical or corresponding parts throughout the first and second preferred embodiments, and the same parts will not be explained to avoid repetition.

Referring to FIG. 2, the second preferred embodiment is very similar in structure to the first preferred embodiment. The second preferred embodiment is just different from the first preferred embodiment in that the refrigerating system is further provided with a housing 30, which will be explained below. The housing 30 is interposed between the ejector 27 and the filter 32. It is preferable that the housing 30 is mounted on a pipe 27*a* which is connected to the ejector 27 and the filter 32. The pipe 27*a* passes through the inside of the housing 30. The housing 30 is connected to the output part of the drier 18 and the input part of the expansion valve 24. Therefore, the refrigerant under high temperature discharged from the drier 18 passes through the housing 30 and is delivered to the expansion valve 24. The housing 30 is of a hollow type.

Thus, the refrigerant passing through the ejector 27 and the filter 32 and delivered to the compressor 10 is pure gas. That is to say, the refrigerant is delivered to the compressor 10 in a perfect gaseous state without any water therein. In other words, since the housing 30 is filled with the refrigerant under high temperature, the refrigerant fed from the evaporator through the housing 30 becomes the complete gaseous state by gaining heat while passing through the pipe 27*a* and then is delivered to the compressor 10. Because of that, the gas and liquid phase separator 29 is not required in the second preferred embodiment. The compressor 10 doesn't need to compress the liquid refrigerant to change it into gaseous refrigerant by using excessive energy. Finally, the amount of energy used for the compressor 10 is drastically reduced.

Further, the refrigerant under high temperature fed from the drier 18 and stored in the housing 30 is deprived of heat to some degree and then delivered under relatively lower temperature to the expansion valve 24 where decreases the temperature of the refrigerant further. The amount of the evaporating heat generated when the evaporator 26 evaporates the refrigerant will be greatly increased. As a result, the refrigerating performance of the refrigerating system is remarkably improved.

Third Embodiment

Figure 3:
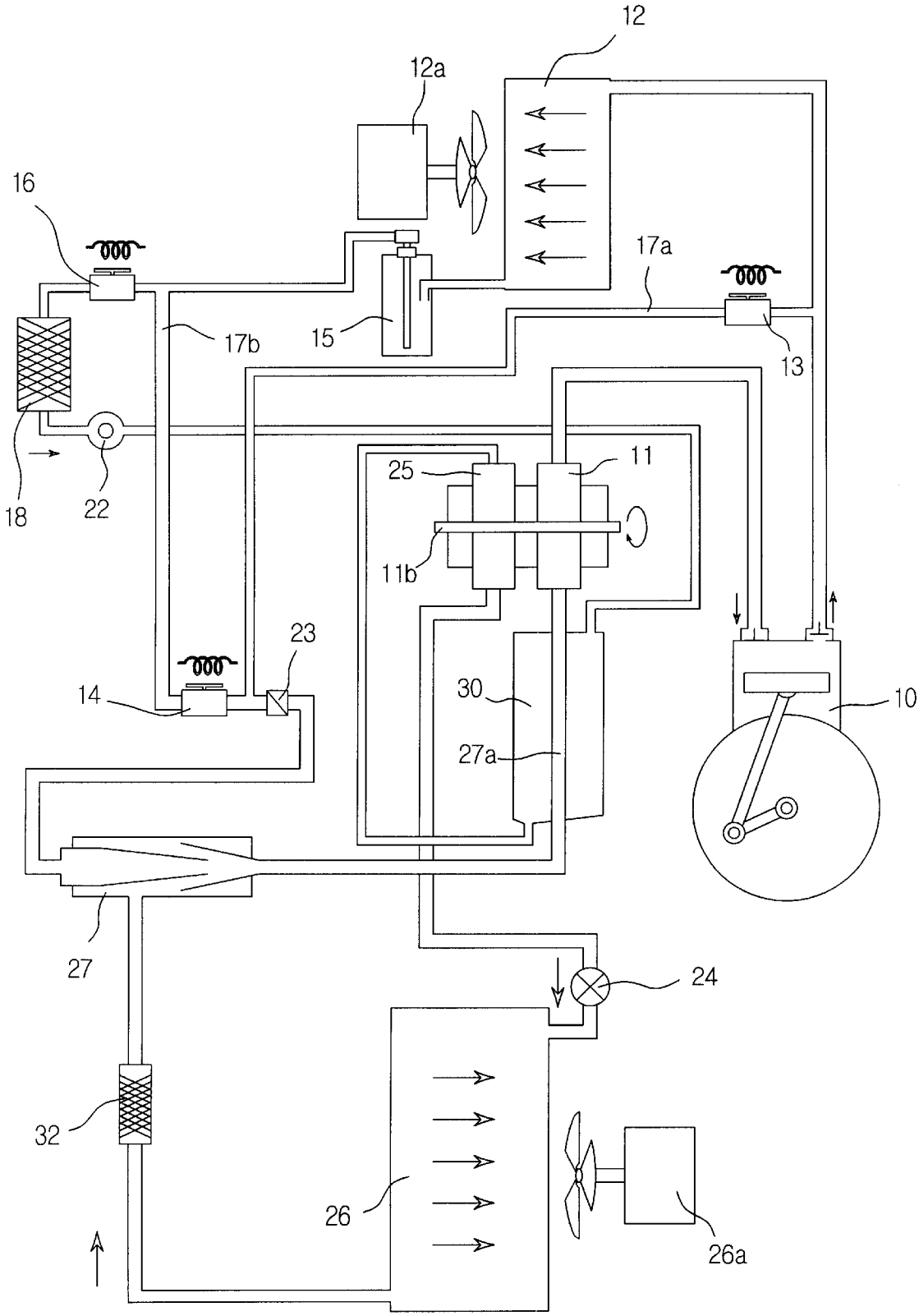
FIG. 3 is a schematic diagram of a refrigerating system according to a third preferred embodiment of the present invention.

FIG. 3 is a schematic diagram of a refrigerating system according to a third preferred embodiment of the present invention. Like reference numerals designate identical or corresponding parts throughout the second and third preferred embodiments, and the same parts will not be explained to avoid repetition.

Referring to FIG. 3, the third preferred embodiment is very similar in structure to the second preferred embodiment. The third preferred embodiment is different from the second preferred embodiment in that the refrigerating system is further provided with a first pump 11 and a second pump 25, which will be explained hereinbelow. The first pump 11 serves to increase pressure and the second pump 25 makes the refrigerant expanded. In the third preferred embodiment, the compressor 10 performs an auxiliary function. Both the first and second pumps 11 and 25 are actuated by an actuating shaft 11*b*. The refrigerant fed from the evaporator 26 enters the input part of the first pump 11, and the output part of the first pump 11 is connected to the compressor 10. The refrigerant fed from the housing 30 enters the input part of the second pump 25, and the output part of the second pump 25 is connected to the evaporator 26.

Hence, the refrigerant under high pressure enters the second pump 25 from the housing 30. Moreover, the refrigerant under high pressure is changed into liquid refrigerant under low temperature and low pressure while passing through the second pump 25. During the course, there is generated in the second pump 25 a pressure difference due to a variation in the pressure of the refrigerant, thereby producing kinetic energy. The kinetic energy is transferred to the actuating shaft 11*b* which actuates the second pump 25, and finally the actuating shaft 11*b* rotates the first pump 11. This means that the kinetic energy of the first pump 11 is identical to that of the second pump 25. Therefore, any external energy doesn't need to be provided to the first and second pumps 11 and 25 for operation.

Since the pressure of the refrigerant entering the compressor 10 is greatly increased with the help of the first pump 11, the amount of energy used for the compressor 10 to change the pressure of the refrigerant into high pressure is accordingly reduced. The refrigerant expanded by the second pump 25 is transformed into one under further lower pressure while passing through the expansion valve 24. Thus, the evaporator 26 can easily evaporate the refrigerant. Finally, the evaporating function of the evaporator is increased, and the refrigerating performance of the system is significantly enhanced.

In a general refrigerating system, there is friction loss due to rotation in devices which exchange heat, and there is hydro-dynamically generated resistance in refrigerant circulating through the system. To efficiently use the refrigerating system, the friction loss and the resistance should be compensated. In the third preferred embodiment, the compressor 10 which performs an auxiliary function can compensate for the friction loss and resistance. That is, the compensation can be sufficiently achieved by controlling the compressor 10. A user can control the compressor 10 discretionarily for her or her convenience. The overall operation of the refrigerating system can be controlled through the control of the compressor 10.

According to the third preferred embodiment, the refrigerant can be changed between high pressure and low pressure by controlling the first and second pumps 11 and 25. The first and second pumps 11 and 25 change the state of the refrigerant by employing one type of method selected from the group consisting of a vane type, a piston type, a scroll type, a gear type, a diaphragm type, a bellows-type, a rotary volumetric type and a rotary turbo type.

Fourth Embodiment

Figure 4:
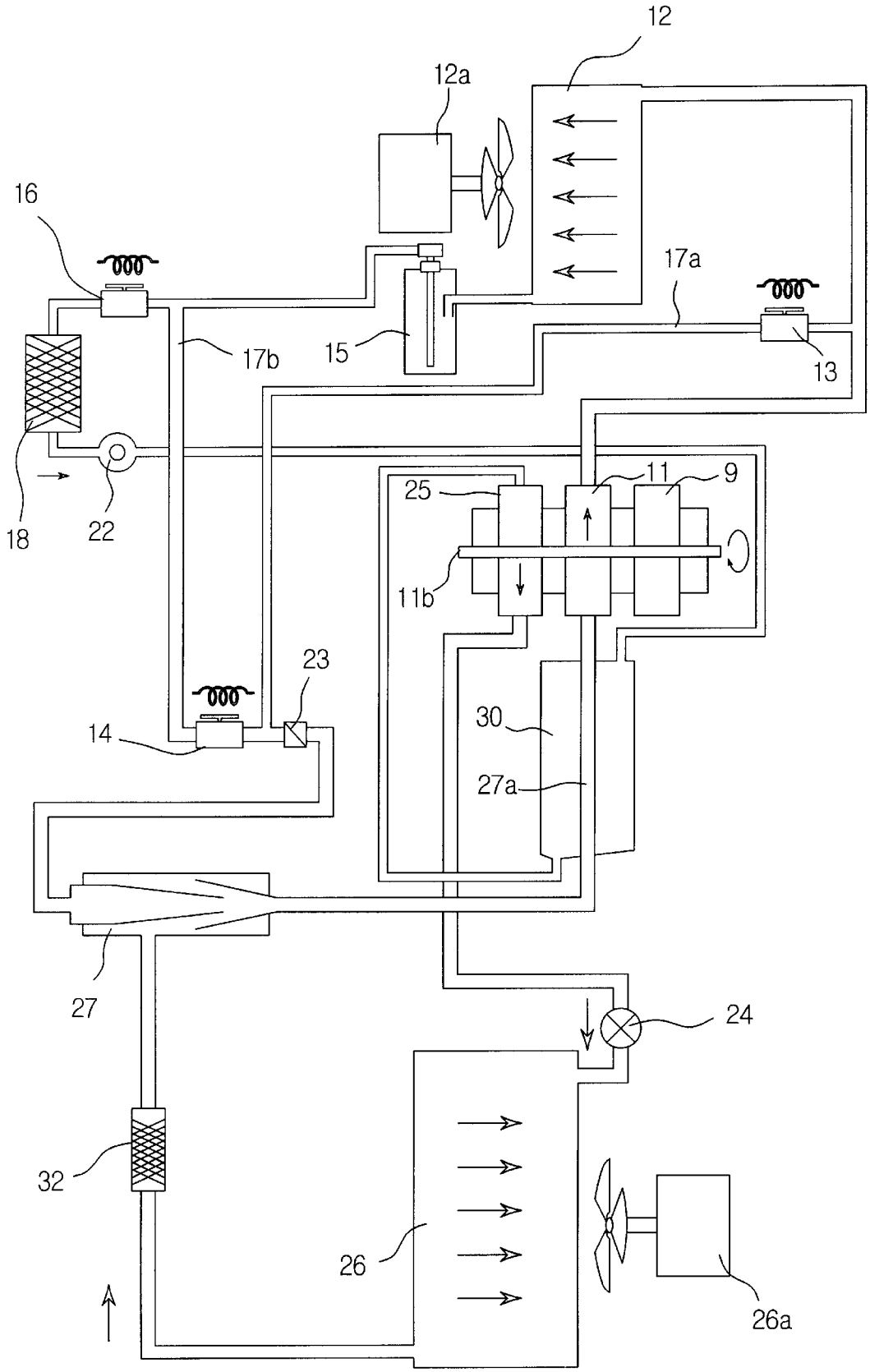
FIG. 4 is a schematic diagram of a refrigerating system according to a fourth preferred embodiment of the present invention.

FIG. 4 is a schematic diagram of a refrigerating system according to the fourth preferred embodiment of the present invention. Like reference numerals designate identical or corresponding parts throughout the third and fourth preferred embodiments, and the same parts will not be explained to avoid repetition.

Referring to FIG. 4, the fourth preferred embodiment is very similar in structure to the third preferred embodiment. However, the fourth embodiment is different from the third preferred embodiment in that the refrigerating system is further provided with a motor 9, which will be explained hereinbelow. The motor 9 is connected to the actuating shaft 11*b* for actuating the first and second pumps 11 and 25. Further, the compressor shown in the third preferred embodiment is not provided in the fourth preferred embodiment because the first and second pumps 11 and 25 can sufficiently conduct the function of the compressor. In this circumstance, the input part of the condenser 12 is connected to the first pump 11. The compressor illustrated in the third preferred embodiment serves to compensate for the friction loss and the resistance generated due to the movement of the refrigerant. In the fourth preferred embodiment, meantime, the motor 9 compensates for the friction loss and the resistance instead of the compressor. Therefore, the structure of the system becomes simple and the production cost is reduced. In the fourth preferred embodiment, since the energy retrieved from the expansion valve 24 is used for compressing the refrigerant, the performance of the system is improved and energy efficiency is strikingly improved.

In the general refrigerating system, when the compressor is actuated, heat is generated in the compressor, and when the refrigerant is compressed, heat is also generated. The above heats become the cause of reduction in the life of the system. Therefore, the fourth preferred embodiment from which the compressor is removed can reduce the amount of energy required and extend the life of the system.

Fifth Embodiment

Figure 5:
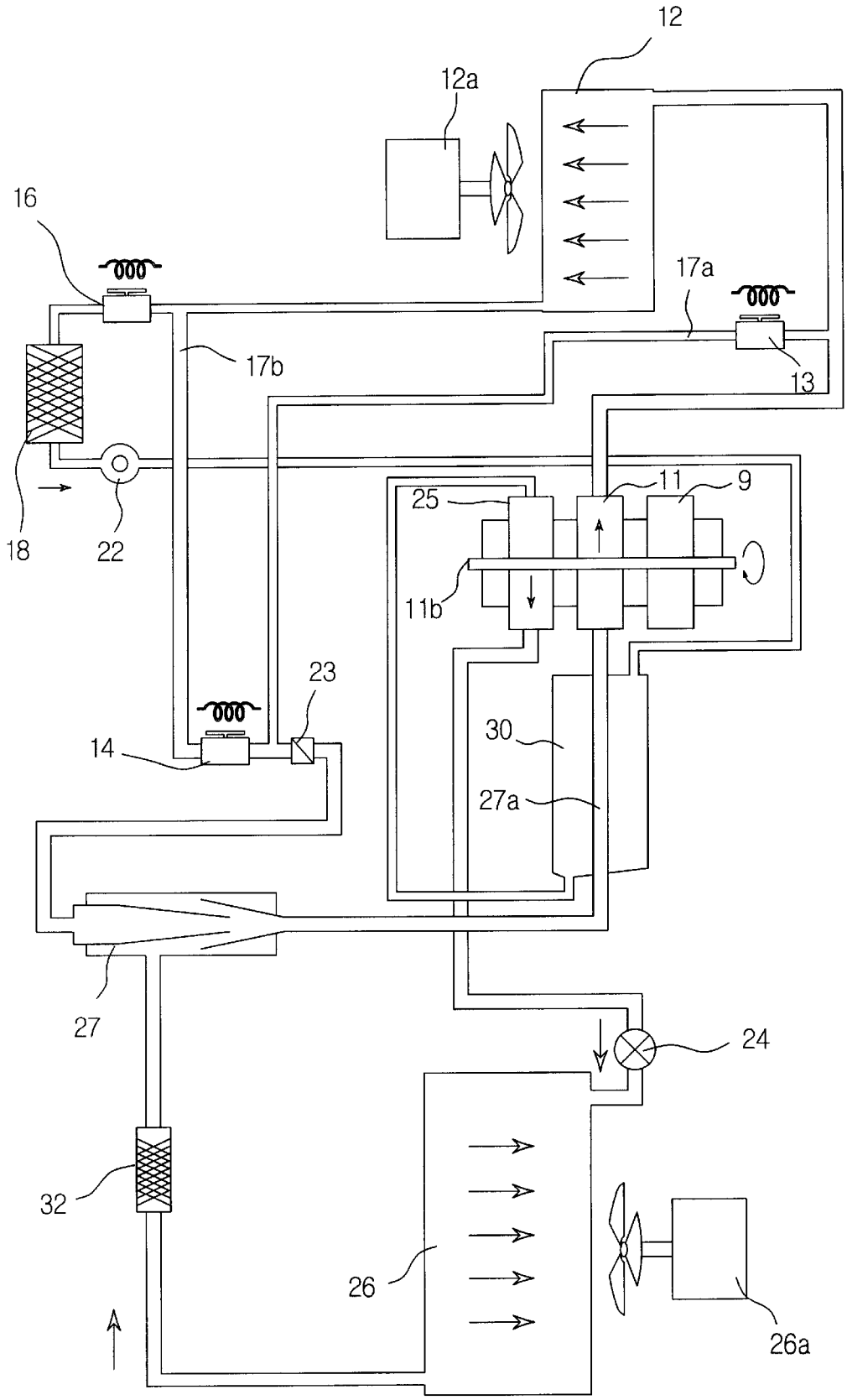
FIG. 5 is a schematic diagram of a refrigerating system according to a fifth preferred embodiment of the present invention.

FIG. 5 is a schematic diagram of a refrigerating system according to a fifth preferred embodiment of the present invention. Like reference numerals designate identical or corresponding parts throughout the fourth and fifth preferred embodiments, and the same parts will not be explained to avoid repetition.

Referring to FIG. 5, the fifth preferred embodiment is very similar in structure to the fourth preferred embodiment. However, the fifth preferred embodiment is different from the fourth preferred embodiment in that the fluid receiving tank is not provided in the refrigerating system. Except that, the fifth preferred embodiment is similar in structure and operation to the first to fourth preferred embodiments.

Sixth Embodiment

Figure 6:
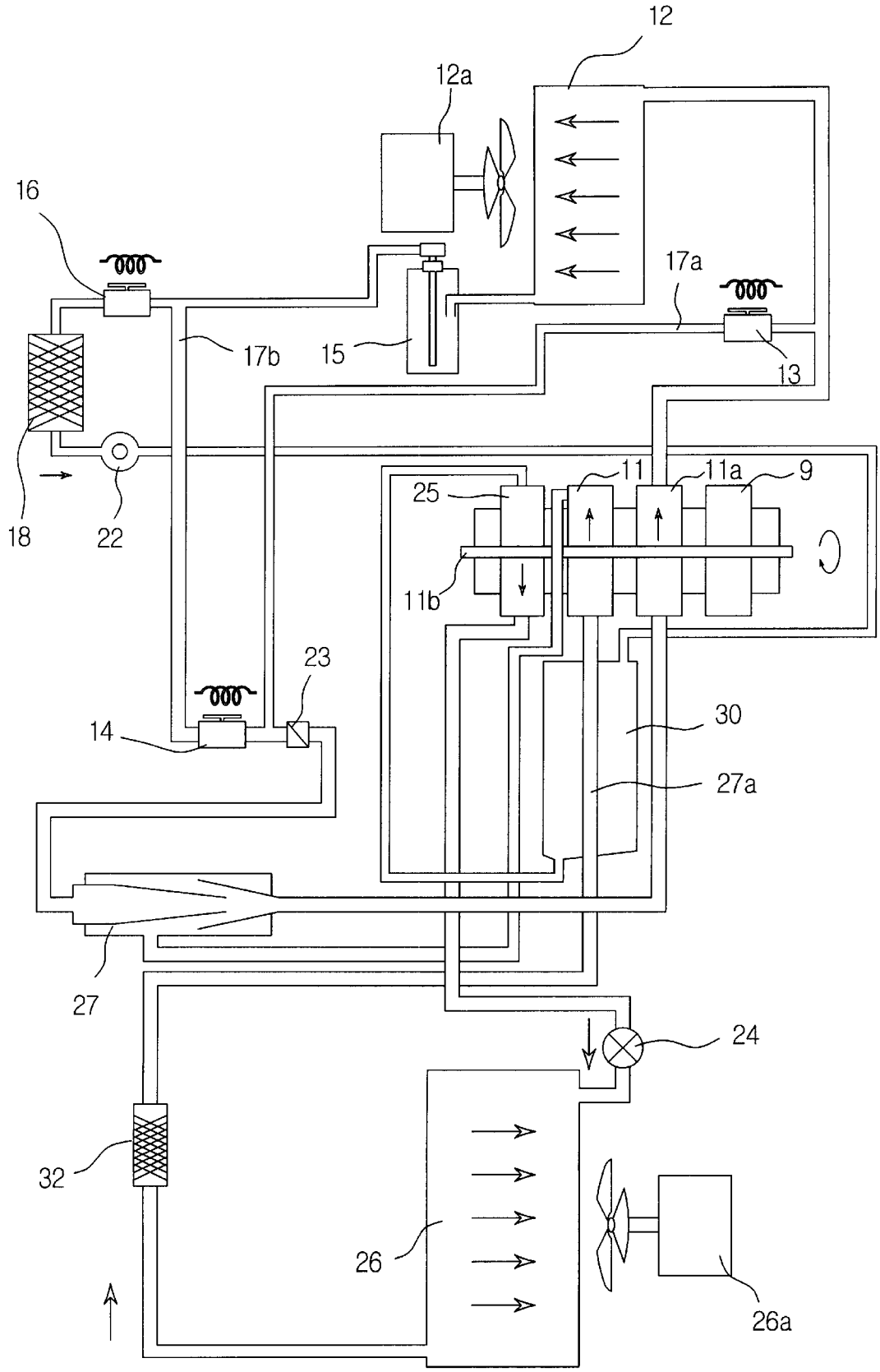
FIG. 6 is a schematic diagram of a refrigerating system according to a sixth preferred embodiment of the present invention.

FIG. 6 is a schematic diagram of a refrigerating system according to a sixth preferred embodiment. Like reference numerals designate identical or corresponding parts throughout the fifth and sixth preferred embodiments, and the same parts will not be explained to avoid repetition.

Referring to FIG. 6, the sixth preferred embodiment is very similar in structure to the fifth preferred embodiment. However, the sixth preferred embodiment differs from the fifth preferred embodiment in that the refrigerating system is further provided with a third pump 11*a* and a fluid receiving tank 15, which will be explained hereinbelow. The fluid receiving tank 15 is located in the same position as the first preferred embodiment and performs its own function. The third pump 11*a* is actuated by the actuating shaft 11*b* which is driven by the motor 9. The third pump 11*a* functions to increase the pressure of the refrigerant, similarly to the first pump 11. That is, the third pump 11*a* receives the refrigerant fed from the evaporator 26 and increases the pressure of the refrigerant. In further detail, the third pump 11*a* receives the refrigerant flowing from the ejector 27 and increases the pressure of the refrigerant like the first pump 11. Thus, the sixth preferred embodiment adopts a two-staged compression cycle. The refrigerant sufficiently compressed by the first and third pumps 11 and 11*a* is delivered to the condenser 12, which can condense the liquid refrigerant into one under high temperature and high pressure more easily. Consequently, the energy used for the condenser 12 is considerably reduced. As a result, the energy efficiency of the system is significantly improved.

Seventh Embodiment

Figure 7:
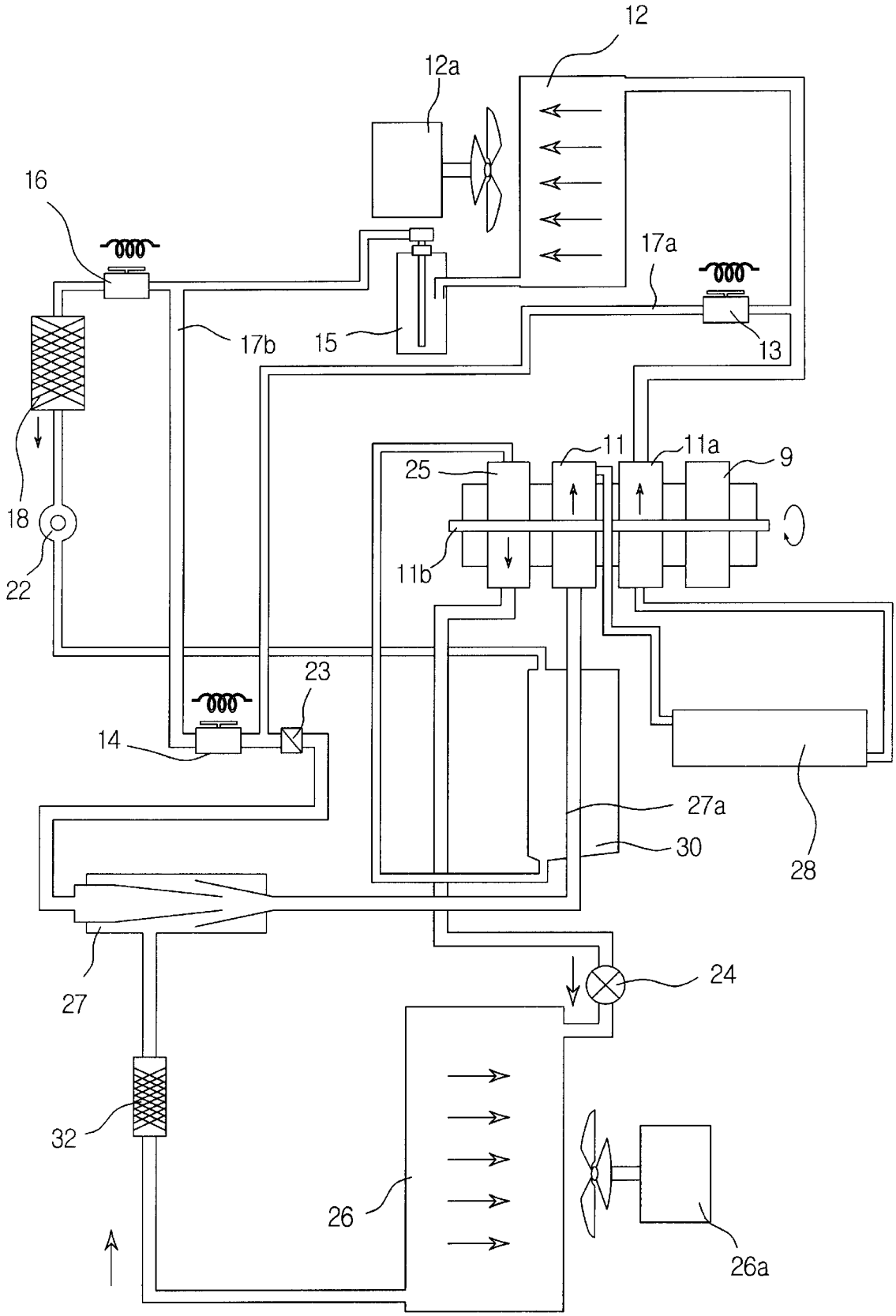
FIG. 7 is a schematic diagram of a refrigerating system according to a seventh preferred embodiment of the present invention.

FIG. 7 is a schematic diagram of a refrigerating system according to a seventh preferred embodiment of the present invention. Like reference numerals designate identical or corresponding parts throughout the sixth and seventh preferred embodiments, and the same parts will not be explained to avoid repetition.

Referring to FIG. 7, the seventh preferred embodiment is very similar in structure to the sixth preferred embodiment. However, the seventh preferred embodiment is different from the sixth preferred embodiment in that the refrigerating system is further provided with a cooler 28, which will be explained hereinbelow. The cooler 28 is interposed between the first pump 11 and the third pump 11*a* for improving the performance of the pumps. The cooler 28 is connected to the first pump 11 on the inlet end thereof for first increasing the pressure and connected to the third pump 11*a* on the output end thereof for secondly increasing the pressure.

In the seventh preferred embodiment, the refrigerant passing through the first pump 11 for the first pressure increase passes through the cooler 28 and then is introduced into the third pump 11*a* for the second pressure increase, thereby increasing the performance of the refrigeration cycle.

Eight Embodiment

Figure 8:
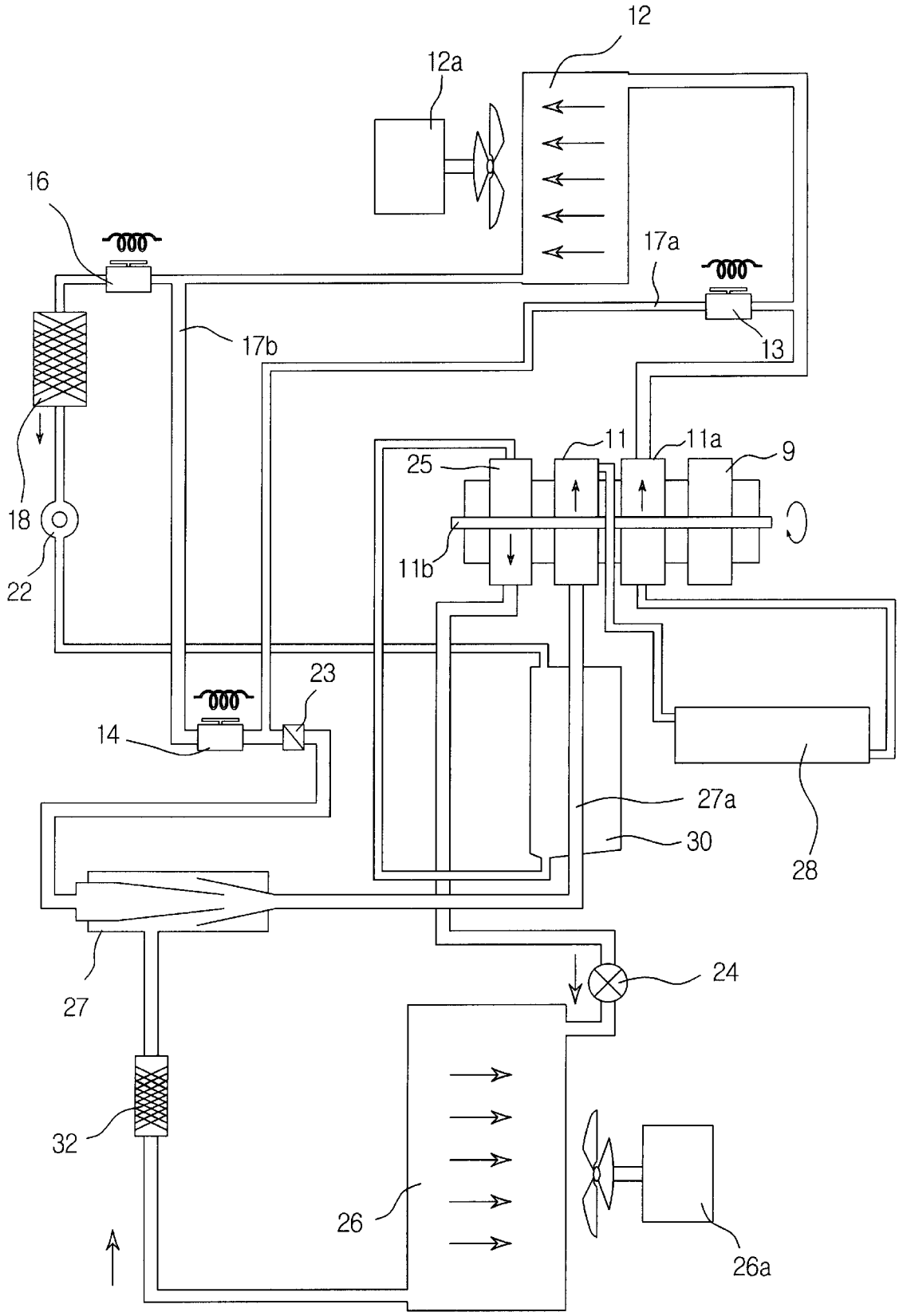
FIG. 8 is a schematic diagram of a refrigerating system according to an eighth preferred embodiment of the present invention.

FIG. 8 is a schematic diagram of a refrigerating system according to an eight preferred embodiment of the present invention. Like reference numerals designate identical or corresponding parts throughout the seventh and eighth preferred embodiments, and the same parts will not be explained to avoid repetition.

Referring to FIG. 8, the eight preferred embodiment is very similar in structure to the seventh preferred embodiment. However, the eighth preferred embodiment is different from the seventh preferred embodiment in that the fluid receiving tank is not provided in the refrigerating system. Except that, since the eighth preferred embodiment is identical in structure and operation to the seventh preferred embodiment, the explanation of the same parts will be omitted.

Ninth Embodiment

Figure 9:
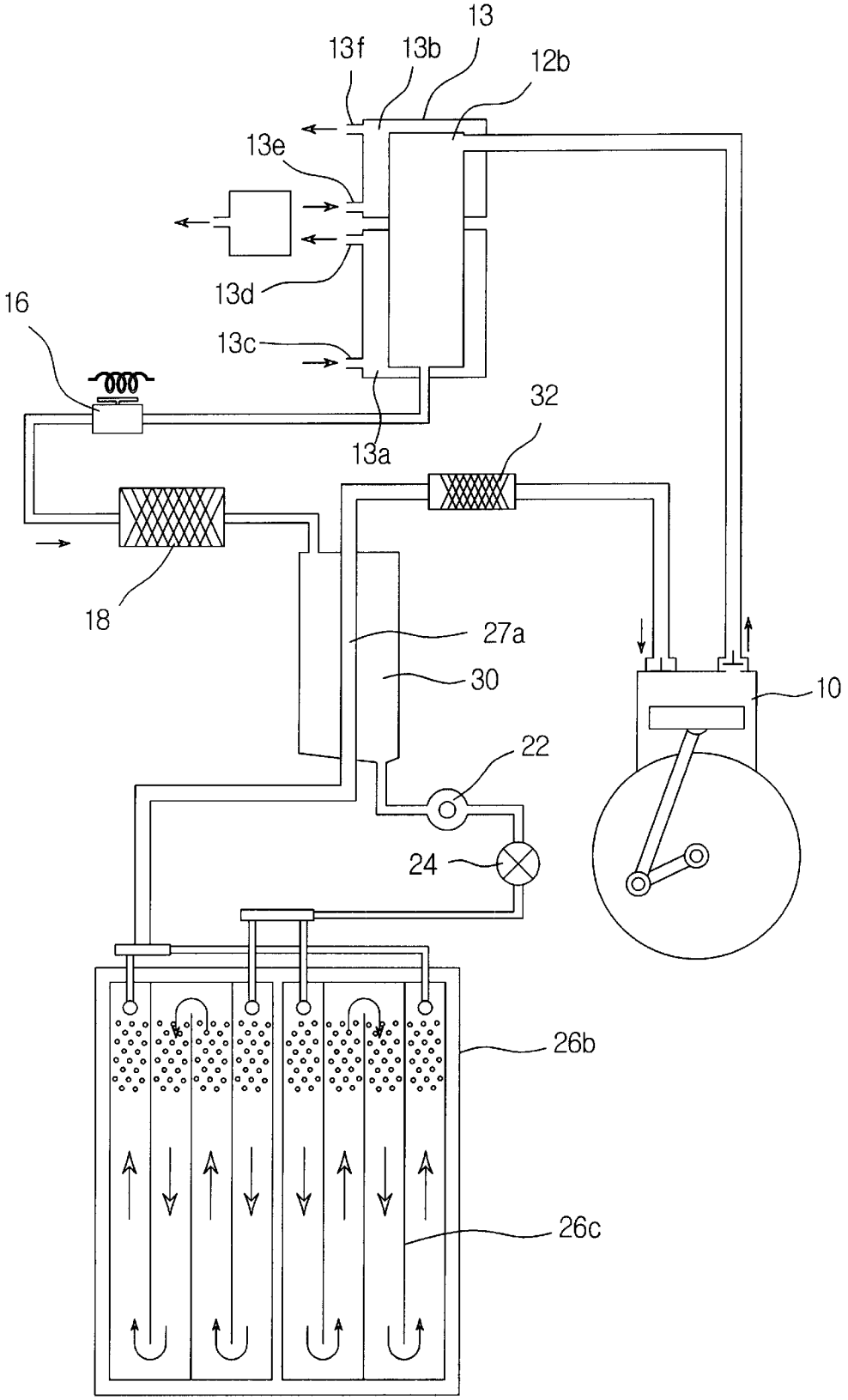
FIG. 9 is a schematic diagram of a refrigerating system according to a ninth preferred embodiment of the present invention.
Figure 10:
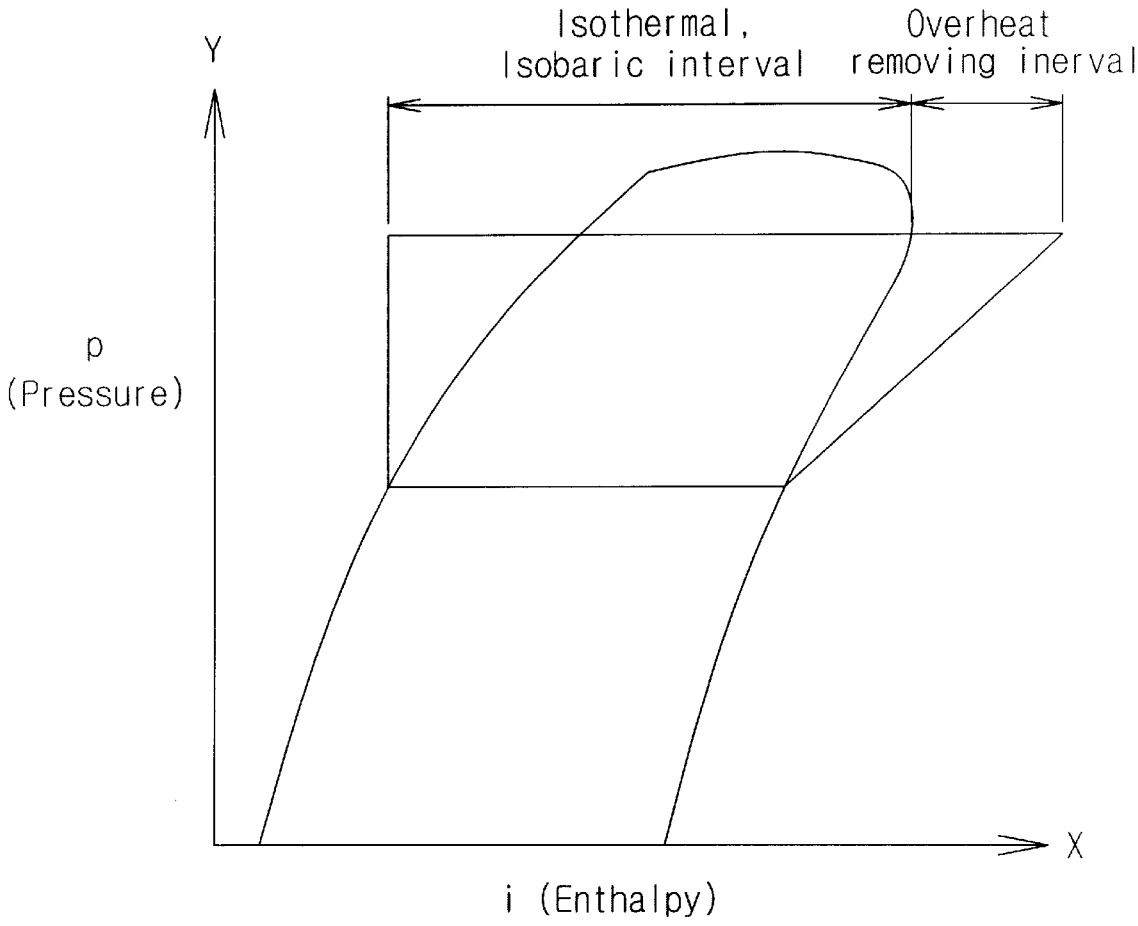
FIG. 10 is a graph showing a calorific value as a relationship between the pressure and enthalpy of a condenser in the refrigerating system according to the ninth preferred embodiment of the present invention.

FIG. 9 is a schematic diagram of a refrigerating system according to a ninth preferred embodiment of the present invention. FIG. 10 is a graph showing a calorific value as a relationship between the pressure and enthalpy of a condenser in the refrigerating system according to the ninth preferred embodiment of the present invention to avoid repetition.

Referring to FIG. 9, the refrigerating system is provided with a compressor 10 for compressing refrigerant. A condenser 12*b* is connected to the output part of the compressor 10. The condenser 12 of the first to eighth preferred embodiments condenses the refrigerant by means of cool wind. However, the condenser 12*b* according to the ninth preferred embodiment condenses the refrigerant by means of cooling water, namely, condensate water. It goes without saying that the condenser 12*b* of the ninth preferred embodiment has the same structure as the condenser 12 of the first to eighth preferred embodiments. The condenser 12*b* of the ninth preferred embodiment is installed inside a cooling water container 13 through which the cooling water circulates. Since the cooling water container 13 is of a hollow type and the condenser 12 is installed inside the cooling water container 13, the refrigerant can be condensed by the cooling water. The cooling water container 13 is a split-type. The cooling water container 13 is divided into a first cooling water container 13*a* disposed at the lower portion of the condenser 12*b* and a second cooling water container 13*b* disposed at the upper portion of the condenser 12*b*.

In this structure, the first cooling water container 13*a* is provided with a first inlet 13*c* and a first outlet 13*d* formed on the upper portion and the lower portion thereof, respectively. The cooling water enters the first cooling water container 13*a* through the first inlet 13*c* and is discharged through the first outlet 13*d*, thereby circulating through the first cooling water container 13*a*. The second cooling water container 13*b* is provided with a second inlet 13*e* and a second outlet 13*f* formed on the upper portion and the lower portion thereof, respectively. The cooling water enters the second cooling water container 13*b* through the second inlet 13*e* and is discharged through the second outlet 13*f*, thereby circulating through the second cooling water container 13*b*.

In the ninth preferred embodiment, a part of the cooling water discharged from the first cooling water container 13*a* circulates through the second cooling water container 13*b*. This is for the purpose of reducing the capacity of the condenser 12*b* by forcing the part of the cooling water having circulated through the first cooling water container 13*a* to circulate through the second cooling water container 13*b* too. Accordingly, the ninth preferred embodiment has an advantage in that the efficiency of the condenser 12*b* is remarkably improved and the condensation line of the condenser 12*b* is shortened.

The effect will be described with reference to FIG. 10.

Referring to FIG. 10, the X-axis represents enthalpy, namely heat content, and the Y-axis represents pressure. In the graph, the isothermal/isobaric interval represents cooling water(referred to as first cooling water hereinafter) discharged after circulating through the first cooling water container 13*a*. The overheat removing interval represents cooling water(referred to as second cooling water hereinafter) discharged after a part of the first cooling water circulates through the second cooling water container 13*b*. In the graph, the isothermal/isobaric interval represents net calorific value with respect to the first cooling water. It can be seen from the graph that the calorific value with respect to the second cooling water in the overheat removing interval is smaller than the calorific value with respect to the first cooling water. When the part of the first cooling water fed from the first cooling water container 13*a* circulates through the second cooling water container 13*b*, the total capacity of the condenser 12*b* is reduced. Therefore, the efficiency of the condenser 12*b* is increased, and the condensation line of the condenser 12*b* is shortened. As a result, refrigerant content of the condenser 12*b* is reduced.

For example, it was found through the experiment that when the temperature of the first cooling water entering the first inlet 13*c* was 30° C., the temperature of the first cooling water discharged through the first outlet 13*d* was about 45° C. A part of the first cooling water of 45° C. re-circulated through the second cooling water container 13*b*, and the second cooling water discharged through the second outlet 13*f* was measured. The measurement result was about 70° C. Seeing that, the features shown in the graph can be sufficiently substantiated.

In the ninth preferred embodiment, the refrigerant condensed by the condenser 12*b* passes through the solenoid valve 16, the drier 18, the housing 30, the expansion valve 24 and the evaporator 26*b*. Then, the refrigerant fed from the evaporator passes through the housing 30, the pipe 27*a* and the filter 32 and is fed back to the compressor 10. the function of refrigeration and cold storage can be performed through this circulation system.

In this process, the evaporator 26*b* of the ninth preferred embodiment has a different structure from the evaporator 26 of the first to eighth preferred embodiments in order to reduce the amount of refrigerant remaining and resistance generated when the refrigerant passes through the evaporator 26*b*. The evaporator 26 of the first to eighth preferred embodiments has a general structure. The evaporator 26 is provided with a plurality of long refrigerant pipes. Accordingly, there is hydro-dynamically generated resistance when the refrigerant passes through the refrigerant pipes. Furthermore, since the refrigerant pipes are long, there remain lots of refrigerant inside the refrigerant pipes. Because of that, the performance of the evaporator 26 is drastically decreased. The evaporator 26*b* according to the ninth preferred embodiment is suggested to solve those problems.

To solve the problems, the evaporator 26*b* has two closed chambers. In each chamber, a plurality of partition plates 26*c* are disposed in each chamber in such a manner that paths are vertically formed in a zigzag fashion to communicate with each other. The refrigerant fed from the expansion valve 24 and admitted to the input parts of the chambers passes through the paths defined by the plurality of partition plates 26*c* in a zigzag fashion so as to be evaporated and discharged toward the filter 32. In this structure, it can be understood that the distance, which the refrigerant has to cover when passing through the evaporator 26*b*, is drastically shortened. Since the evaporator 26*b* is a split-type, the distance, which the refrigerant has to cover, is further shortened. If the interval between the plurality of partition plates 26*c* is widened, the resistance which the refrigerant has to suffer when passing through the paths will be proportionally reduced. However, the interval should be widened within a range capable of maintaining the original function of the evaporator 26*b*. Thus, the amount of refrigerant remaining and the resistance of the refrigerant passing through the evaporator 26*b* will be significantly reduced.

Figure 11A:
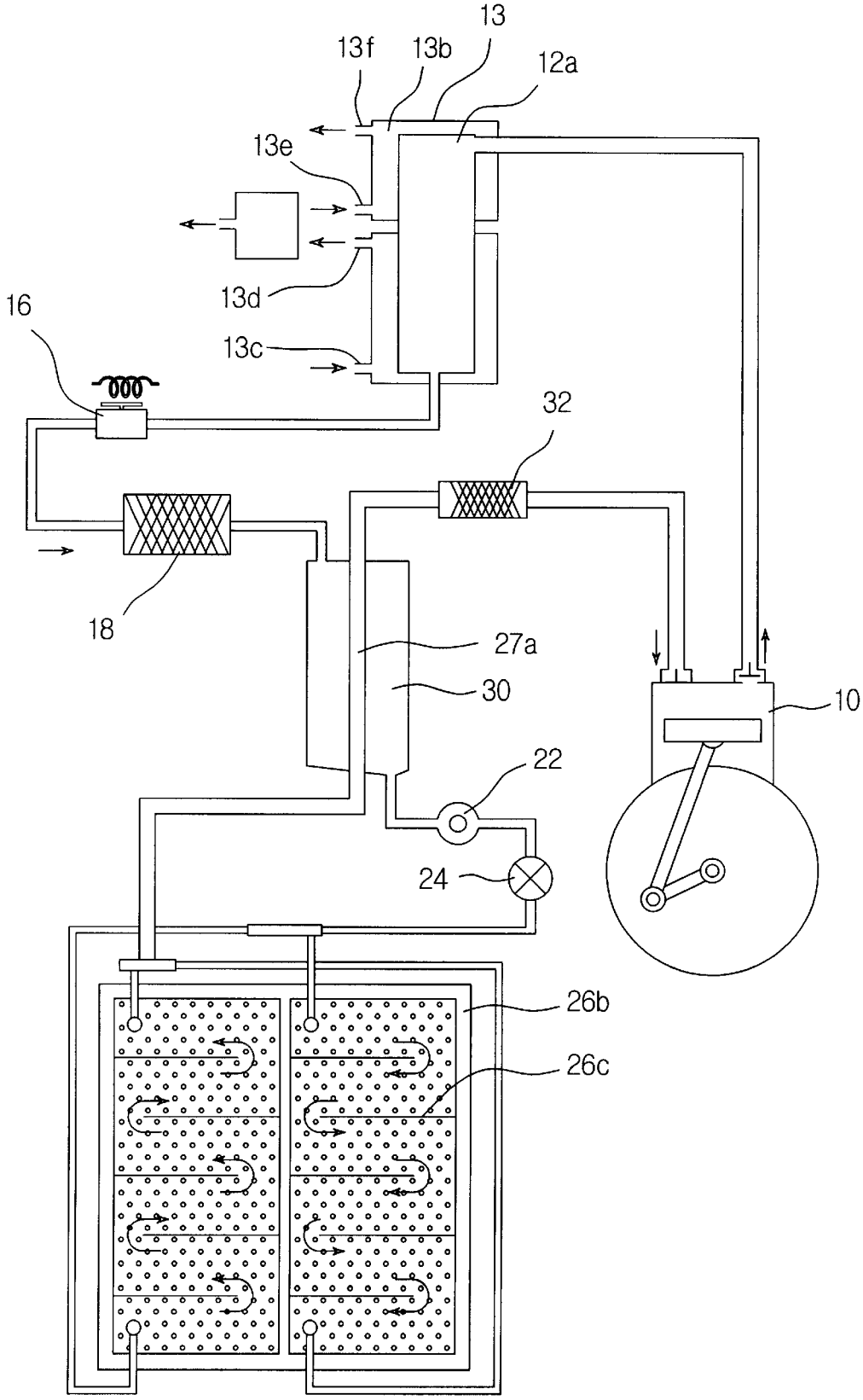
FIG. 11*a* is a schematic diagram illustrating a modification of an evaporator in the refrigerating system according to the ninth preferred embodiment of the present invention.
Figure 11B:
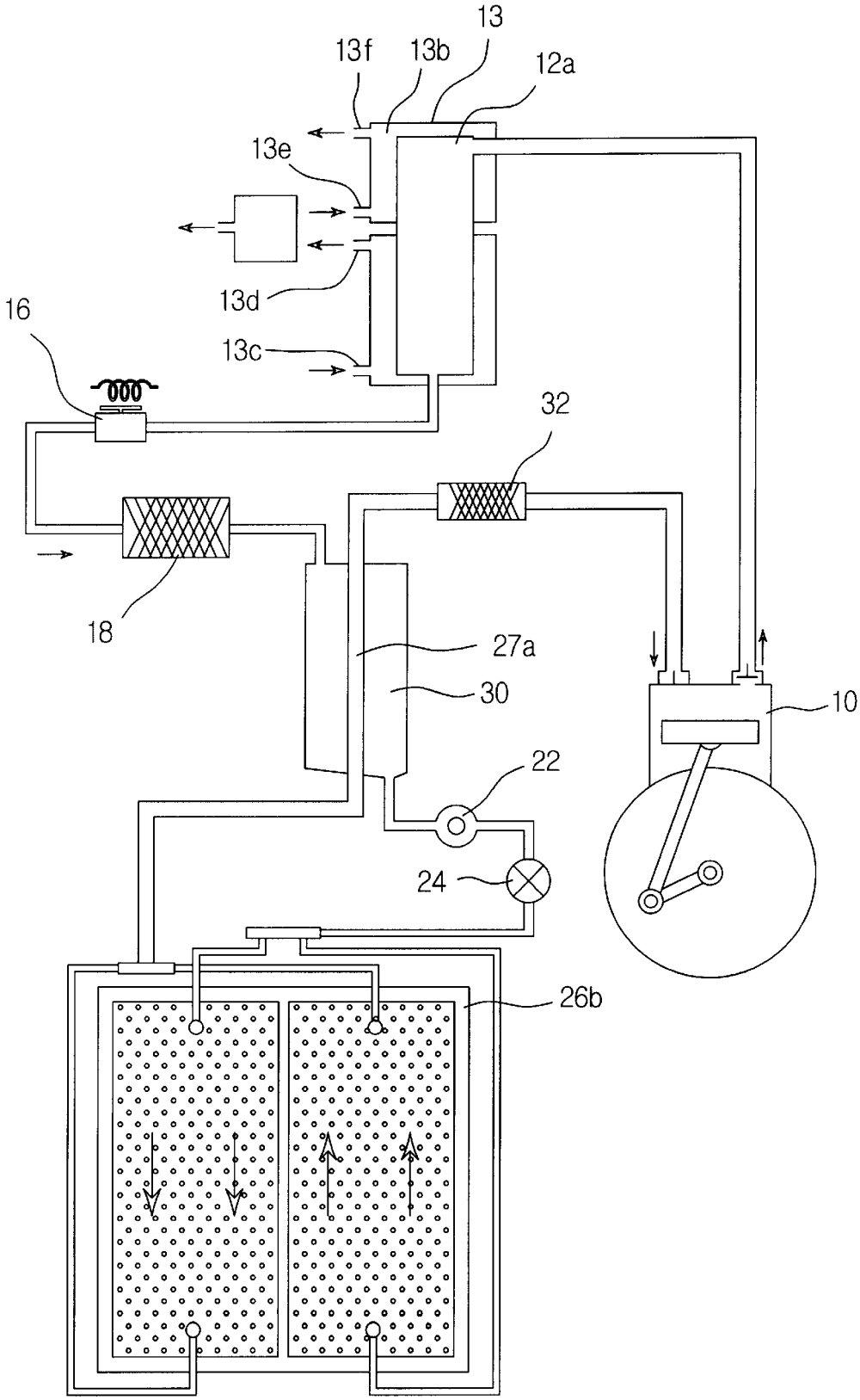
FIG. 11*b* is a schematic diagram illustrating another modification of the evaporator in the refrigerating system according to the ninth preferred embodiment of the present invention.

The evaporator 26*b* can be modified into various types of structures as shown in FIGS. 11*a* and 11*b*. FIG. 11*a* illustrates an evaporator 26*b* having two closed chambers in which a plurality of partition plates 26*c* are horizontally installed in a zigzag pattern to define paths. FIG. 11*b* illustrates an evaporator 26*b* having only two closed chambers. The evaporator in FIG. 11*b* permits the refrigerant to pass directly through the chambers in opposite directions, such that the resistance of the refrigerant and the amount of refrigerant remaining are reduced.

Tenth Embodiment

Figure 12:
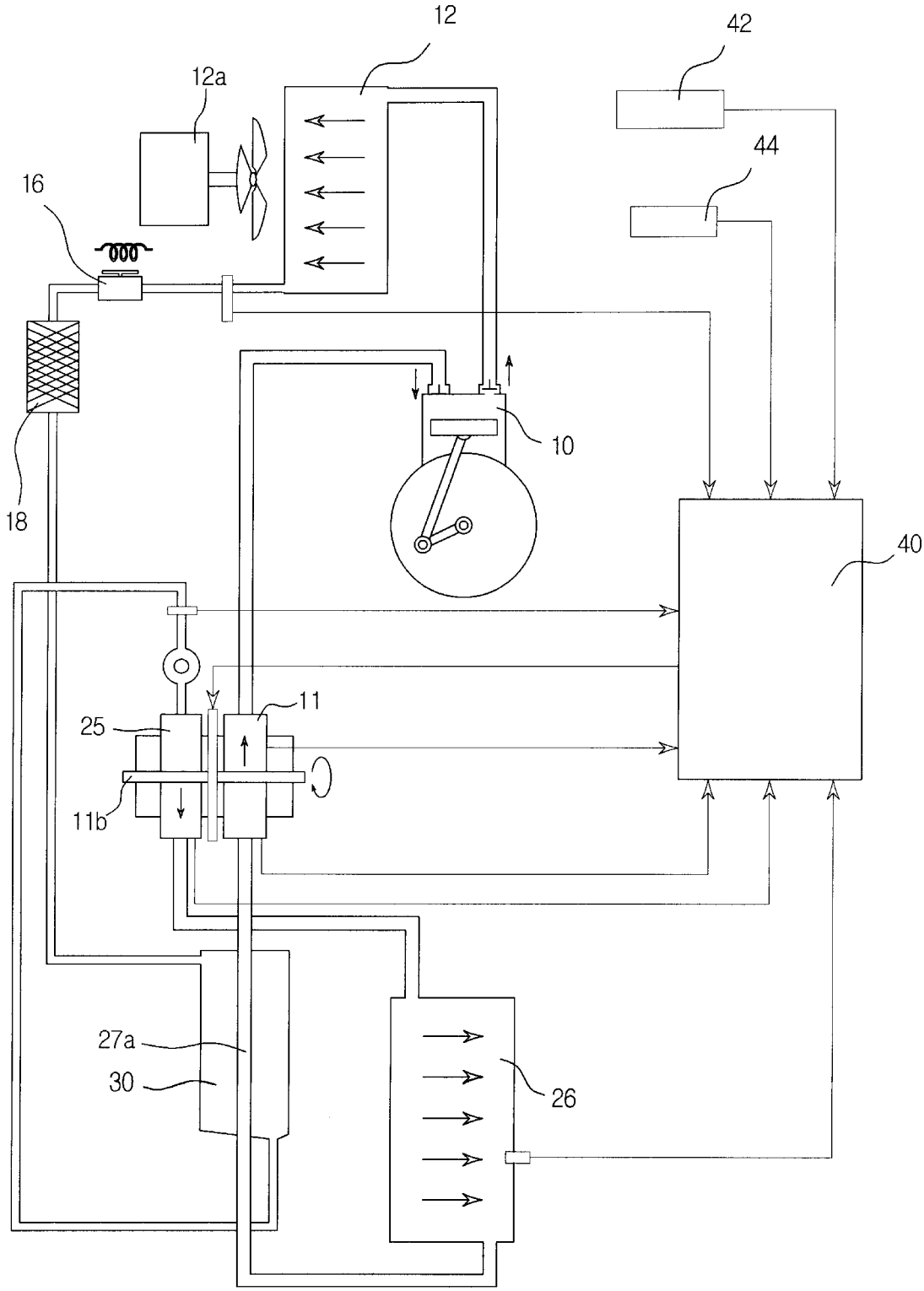
FIG. 12 is a schematic diagram of a refrigerating system according to a tenth preferred embodiment of the present invention.

FIG. 12 is a schematic diagram of a refrigerating system according to a tenth preferred embodiment. Like reference numerals designate identical or corresponding parts throughout the preferred embodiments, and the same parts will not be explained to avoid repetition.

Referring to FIG. 12, the tenth preferred embodiment includes the compressor 10, which performs an auxiliary function. Since the first and second pumps 11 and 25 depicted in he third preferred embodiment are included in the tenth preferred embodiment, the compressor 10 conducts the auxiliary function with respect to the first and second pumps 11 and 25. According to the tenth preferred embodiment, the refrigerant passes through the compressor 10, the condenser 12, the solenoid valve 16, the drier 18, the housing 30, the second pump 25 and the evaporator 26. Then, the refrigerant fed from the evaporator 26 passes through the pipe 27*a*, which passes through the housing 30, and the first pump 11 and is fed back to the compressor 10. The function of refrigeration and cold storage can be performed through this refrigeration cycle in the tenth preferred embodiment. Since the refrigeration cycle of the tenth preferred embodiment can be sufficiently understood with reference to the first to ninth preferred embodiments, the explanation thereof will be omitted.

Eleventh Embodiment

Figure 13:
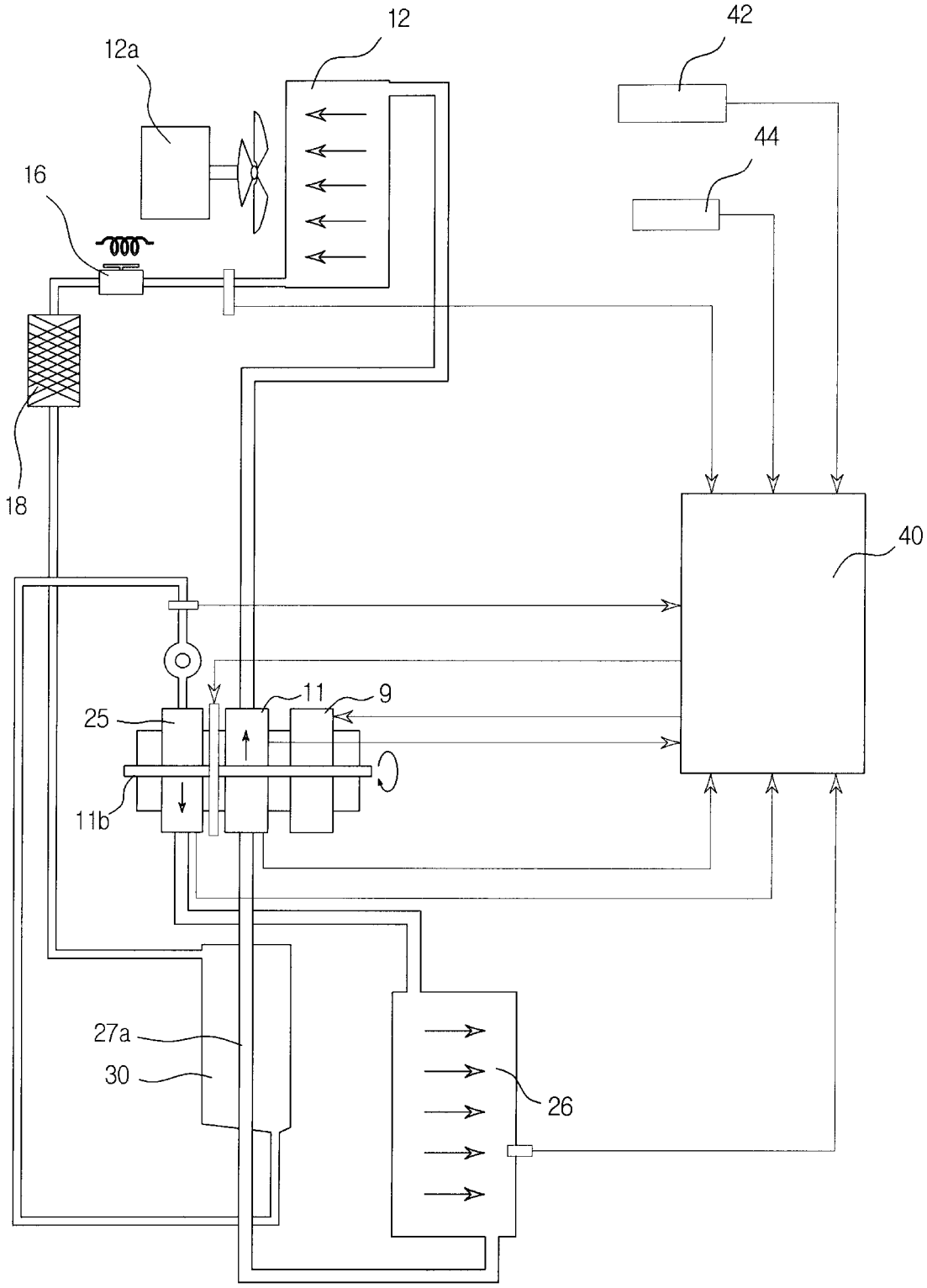
FIG. 13 is a schematic diagram of a refrigerating system according to an eleventh preferred embodiment of the present invention.

FIG. 13 is a schematic diagram of a refrigerating system according to an eleventh preferred embodiment of the present invention. Like reference numerals designate identical or corresponding parts throughout the preferred embodiments, and the same parts will not be explained to avoid repetition.

Referring to FIG. 13, the eleventh preferred embodiment is very similar in structure to the tenth preferred embodiment. However, the eleventh preferred embodiment differs from the tenth preferred embodiment in that the motor 9 is included in the refrigerating system instead of the compressor. Thus, the motor 9 will be explained hereinbelow. In contrast to the tenth preferred embodiment, the motor 9 shown in the fourth and fifth preferred embodiments is provided in the eleventh preferred embodiment. Because of the motor, the compressor doesn't need to be used. According to the eleventh preferred embodiment, the refrigerant passes through the condenser 12, the solenoid valve 16, the drier 18, the housing 30, the second pump 25 and the evaporator 26, and then the refrigerant fed from the evaporator 26 passes through the pipe 27*a*, which passes through the housing 30, and the first pump 11 and is fed back. The function of refrigeration and cold storage can be performed through this refrigeration cycle. The structure of the eleventh preferred embodiment employing the refrigeration cycle can be sufficiently understood with reference to the first to ninth preferred embodiments and the explanation thereof will be omitted.

The tenth and eleventh preferred embodiments constructed as above are provided with a controller 40. The controller 40 automatically controls the overall operation of the system on the basis of signals inputted from sensors attached to the respective devices which constitute the system. Programs of the controller 40, for example, set values are changeable according to the user's demands. Therefore, the user can conveniently control the system of the tenth and eleventh preferred embodiments by operating the controller 40. The controller 40 controls the rotation velocity of the motor installed in each device of the tenth and eleventh preferred embodiments through analogue, digital or phase (Hz) control method.

That is, there are inputted to the controller 40 a signal of the second pump 25 indicating whether the liquid refrigerant exists, a signal of the output part of the condenser 12 indicating whether the refrigerant is appropriately condensed, a signal of the evaporator 26 indicating whether the refrigerant is appropriately evaporated and a signal of the first pump 11 indicating whether the pressure of the refrigerant is appropriately increased. Besides, a signal regarding the change of pressure is also inputted from the second pump 25 to the controller 40. The controller 40 reads the signals transmitted from the respective devices and controls the actuations of the devices on the basis of the signals.

The controller 40 adjusts capacity balance between the first and the second pumps 11 and 25. The controller 40 controls whether the compressor 10 and the motor 9 shown in the tenth preferred embodiment are turned on or off. The controller 40 allows an external temperature sensor 42 and an internal temperature sensor 44 to be connected thereto. The controller 40 can control the overall operation of the system on the basis of temperature signals sent by the respective temperature sensors 42 and 44.

The control circuit including the controller 40 serves to efficiently control the system of the tenth and eleventh preferred embodiments. Accordingly, the tenth and eleventh preferred embodiments can effectively accomplish the objectives of the present invention. Of course, the control circuit including the controller 40 can be applied to the structures of the first to ninth preferred embodiments.

As described above, the present invention has an advantage of improving the energy efficiency of the system since the energy lost when the pressure of the refrigerant is changed from high pressure to low pressure is retrieved and reused. The present invention has another advantage of providing the refrigerating system having a simple structure at low costs. The present invention has further another advantage in that when it is applied to a refrigerator, an air conditioner, a heat pumps and the like, their performance is enhanced and the amount of energy to be used is reduced.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A refrigerating system comprising:

a refrigerant circulating part having a compressor for compressing refrigerant, a condenser for condensing the refrigerant and an evaporator for evaporating the refrigerant;

a plurality of magnet valves connected to the output part of the compressor and the output part of the condenser for measuring the temperature and pressure of a part of the refrigerant discharged from the compressor and condenser;

a plurality of by-pass pipes communicating with the magnet valves and operated under the control of the magnet valves for by-passing the part of the refrigerant to the compressor in order to recompress it; and an ejector connected to the by-pass pipes and the evaporator for ejecting the part of the refrigerant fed from the by-pass pipes and the refrigerant fed from the evaporator back to the compressor based on the venturi principle so as to compensate for reduced energy of the compressor.

2. The refrigerating system according to claim 1, further comprising a controller for controlling the overall operation of the refrigerating system.

3. The refrigerating system according to claim 1, further comprising a housing interposed between the ejector and the compressor and connected to the output part of the condenser and the input part of the evaporator for completely evaporating the refrigerant flowing from the evaporator and passing therethrough.

4. The refrigerating system according to claim 3, further comprising a first pump interposed between the ejector and the compressor for increasing the pressure of the refrigerant flowing from the ejector and a second pump interposed between the condenser and the evaporator and coaxially disposed with the first pump for expanding the refrigerant flowing from the condenser.

5. The refrigerating system according to claim 4, further comprising a motor interposed between the first pump and the second pump.

6. The refrigerating system according to claim 5, further comprising a third pump interposed between the ejector and the condenser for increasing the pressure of the refrigerant flowing from the ejector.

7. The refrigerating system according to claim 6, further comprising a cooler interposed between the first pump and the third pump for decreasing the temperature of the refrigerant flowing from the first pump.

8. A refrigerating system comprising:

a compressor for compressing and pumping refrigerant;

a condenser connected to the compressor for condensing the refrigerant pumped by the compressor by means of cooling water; and an evaporator having two closed chambers and connected to the condenser for evaporating the refrigerant flowing from the condenser while making the refrigerant flowing through the chambers thereof vertically or horizontally.

9. The refrigerating system according to claim 8, further comprising a controller for controlling the overall operation of the refrigerating system.

10. The refrigerating system according to claim 8, further comprising a cooling water container for circulating the cooling water therethrough, wherein the condenser is installed inside the cooling water container.

11. The refrigerating system according to claim 10, wherein the cooling water container is a split-type, and a part of the refrigerant flowing from a first cooling water container is introduced to a second cooling water container.

* * * * *